United States Patent [19]

Caprio

[11] Patent Number: 4,726,588

[45] Date of Patent: Feb. 23, 1988

[54] MAGNETIC DETENT DEVICE AND PUZZLE GAME DEVICE

[75] Inventor: Anthony G. Caprio, Mt. Laurel, N.J.

[73] Assignee: Balls-N-Bars, Inc., Mt. Laurel, N.J.

[21] Appl. No.: 897,327

[22] Filed: Aug. 18, 1986

[51] Int. Cl.[4] ..... A63F 7/04; A63F 9/08; H01H 21/30

[52] U.S. Cl. ..... 273/153 R; 200/67 F; 272/8 R; 273/1 M; 273/109; 335/303; 446/131

[58] Field of Search ..... 273/1 GB, 1 GD, 1 M, 273/153 R, 153 S, 109; 200/67 F, 76; 335/170, 302, 303; 272/8 R, 8 N; 446/131

[56] References Cited

U.S. PATENT DOCUMENTS

| | | | |
|---|---|---|---|
| 417,931 | 12/1889 | Miatt . | |
| 1,262,662 | 4/1918 | Gornston . | |
| 1,535,035 | 4/1925 | Philipp . | |
| 1,859,764 | 5/1932 | Bougon | 272/8 N UX |
| 2,760,744 | 8/1956 | Watrous | 248/122 |
| 2,961,796 | 11/1960 | Davis | 446/131 |
| 2,970,388 | 2/1961 | Yonkers . | |
| 3,077,696 | 2/1963 | Barnett et al. . | |
| 3,124,356 | 3/1964 | Chordas | 273/93 |
| 3,201,125 | 8/1965 | Vensel . | |
| 3,254,859 | 6/1966 | Reisch | 335/303 |
| 3,414,852 | 12/1968 | Martin | 335/170 |
| 3,653,662 | 4/1972 | Welbourn . | |
| 3,731,722 | 5/1973 | Carr | 145/50 |
| 3,732,512 | 5/1973 | Puttick | 335/302 |
| 4,021,042 | 5/1977 | Sweeton . | |
| 4,178,707 | 12/1979 | Littlefield | 40/426 |
| 4,339,120 | 7/1982 | Czarny | 272/8 R |

FOREIGN PATENT DOCUMENTS

| | | | |
|---|---|---|---|
| 1265950 | 4/1968 | Fed. Rep. of Germany | 294/65.5 |
| 954370 | 4/1964 | United Kingdom | 335/285 |
| 1162550 | 8/1969 | United Kingdom | 200/67 F |
| 1225261 | 3/1971 | United Kingdom . | |

*Primary Examiner*—Anton O. Oechsle
*Attorney, Agent, or Firm*—Thomas A. Lennox

[57] ABSTRACT

A detenting device used in the form of a puzzle including magnets and balls using a nonmagnetic tube around which an annular tubular magnet surrounds the tube with one magnetic pole on the entire inside surface of the tubular magnet and the opposite magnetic pole on the entire outside surface of the magnet wherein the ball or other magnetically attracted body is positioned at either one end or at the other end of the magnet requiring force to dislodge it from either position to the other position.

15 Claims, 5 Drawing Figures

MAGNETIC DETENT DEVICE AND PUZZLE GAME DEVICE

BACKGROUND OF THE INVENTION

This invention involves a detenting device that fixes and holds a position in either of two set positions using magnetic forces.

In addition, this invention involves a puzzle device with balls in a tube solved by placing the balls in particular positions. Once the balls are placed in the solution position, the balls may be caused to move in a pleasant intriguing pattern.

There are a number of puzzles available utilizing magnets and balls, generally utilizing a maze and a magnetic wand to pull the balls into positions. In addition, there are devices which utilize rolling balls from position to position in pleasant patterns and configurations. However, there are no puzzles that require placement of the balls in a particular position which, once the balls have been placed in the position, by further movement of the device produce a pleasant pattern of movement essentially as a reward for correctly positioning the balls.

In addition, most detent devices involve the use of spring loaded members which act frictionally against a moving body. In time, through wear, the firmness of the detent and the accuracy of the placement of the body tends to wear out. Further, through loss of spring force, the detent becomes less and less accurate and less and less effective to provide a positive and accurate positioning of the moving body. There is a need to provide a detenting device which provides a positive positioning of the body which will not wear out and does not depend upon spring loading or other physical force to position the body in the chosen position. Further, there is the need for a simple and inexpensive detenting device that will provide two positions which will place the body in one position or the other without fail, which will not wear out through use. None of the prior art devices satisfy the above needs nor obtain the objects listed herein below.

SUMMARY OF THE INVENTION

It is an object of the present invention to provide a detent device which might be used in a switch or like mechanism to provide two positive hold positions, that are separate and distinct and provide a positive indication of position.

It is a further object of the present invention to provide a device that may be moved by positive force from one position to a second position and each position is stable and requires an equal but opposite force to dislodge the device from that position and to achieve the original position.

It is a particular object of the present invention to provide a double detent device which holds a member in one of two positions wherein force may be applied to the member to push the member from one position to the second position, each position being stable and requiring an equal but opposite force to disengage the member from either position and to place the member in the other position.

It is a further object of the present invention to provide a detent devices where there is essentially no possibility of wear or loss or diminishment of the forces creating the detent.

It is an object of the present invention to provide a puzzle device which, as its preliminary solution requires positioning of the ball along the length of a transparent tube.

It is a further object of the invention to provide a puzzle device which requires as its solution the separation of steel balls along the length, one ball at one end of the tube and the other two balls at particular positions in intermediate positions.

It is an additional object of the present invention to provide a puzzle device utilizing magnets that will aid in the positioning of the balls along the length of a transparent tube.

It is a further object of the present invention to provide a puzzle device that once the balls have been positioned correctly along the length of the tube with one ball at one end and the other two balls in intermediate positions that by tilting the tube away from the single ball close to the end, that the balls will exchange positions leaving a ball at the now lower end of the tube and the other two balls held in intermediate position by the magnet forces. Retilting the device back in the opposite direction will cause the balls to return to their exact original positions.

It is an additional object of the present invention to provide a puzzle device which when the balls are positioned correctly along the length of the tube, tilting the tube to cause movement of the free ball, the free ball appears to pass through each of other balls to reach the other end of the tube.

It is a further object of the present invention to provide a puzzle device utilizing a tube and balls rolling inside that tube wherein through the use of certain magnetic devices allow the balls to be placed in a stable condition wherein tilting the tube one way and then the other will cause the balls to first reorganize in a second position and then return to their original position without fail.

The puzzle device of the present invention includes a translucent, semi-transparent or transparent cylindrical tubular body of nonmagnetic material. The material of the tubular body must be sufficiently translucent to allow viewing of the position of balls rolling within the tubular body and is preferably transparent. A closure device is provided at each end to close the end of the tubular body. A plurality of annular tubular magnets are spaced along the length of the tubular body, with all of the tubular magnets having certain characteristics. A plurality of magnetically attracted spheres, preferably steel balls, are positioned inside the tubular body of a diameter to easily roll along the length of the tubular body from end to end. It is preferred that the ball be just slightly smaller than the inside diameter of the tubular body. The number of steel balls is equal to the number of magnets plus one. Each tubular magnet has a length along the length of the tubular body approximating that of the diameter of the ball. The tubular magnets each have a single magnetic pole on the entire interior surface of the tubular magnet surface and an opposite single magnetic pole on the entire exterior surface of the tubular magnet.

Whenever the term "steel" is used in the specification or the claims, it is intended to include all materials that are attracted by magnetic flux and the term "steel" is not intended to be limiting in any way.

The detenting device of this invention is a positive positioning device including a magnetically attracted body of a shape having a plane of symmetry. It is preferred that the surface of the body at the plane of symmetry extend outwardly from the body at least as great a distance as any other points on the surface of that body. The body, by its shape, balances the line length of magnetic flux through the body making the flux through the body symmetrical. The preferred magnetically attracted body shape is spherical or near spherical. The device further includes a containing device of nonmagnetic material having a length and a cross sectional area normal to that length wherein the cross-sectional area is sufficient to allow the magnetically attracted body to freely move along the length and further that the cross-sectional area is parallel to said plane of symmetry of the magnetically attracted body. The detenting device further includes an annular tubular magnet surrounding the cross-sectional area having two ends separated along the length of the containing device wherein there is one magnet pole on the entire inside surface of the tubular magnet and the opposite magnetic pole on the entire outside surface of the tubular magnet. The detenting device further includes a moving member device to more the magnetically attracted body from one end of the magnet to the other end.

A preferred detenting device includes a housing of nonmagnetic material having a length, a cross-sectional area normal to the length, two ends, and at least one aperture through the housing. The preferred device is further described herein below. An annular tubular magnetic surrounds the housing around the cross-section, having a length along the length of the housing. The magnet is in a tubular form, has a single magnetic pole on the inside surface of the tubular shape, and has a single opposite magnetic pole on the outside surface of the tubular shape. A magnetically attracted spherical body is placed in the housing of a size and a shape movable through the cross-section area along the length of the housing. At least one member fixedly attached to the body extends outwardly and through an aperture in the housing. The length of the housing is sufficient to allow the circumferential line of the plane of symmetry to align with the end position of the tubular magnetic on each side. In operation, the body may be disengaged from one positive position and will engage in the second position at the opposite end of the tubular magnet.

DESCRIPTION OF THE PREFERRED EMBODIMENTS

A critical element of the present invention is the device to position, without fail, a steel ball at a particular location inside a nonmagnetic tube. In particular, the present invention provides a device that will position the ball in either of two specific locations depending upon the particular length of the tubular magnetic system employed.

The ball positioning device includes a cylindrical tube of a size to allow the spherical ball to move either by rolling or sliding along the inside of the surface of the cylindrical tube without significant difference. A cylindrical permanent magnetic device is placed around a cylindrical tube having a length along the central axis of the cylindrical tube. The magnetic device has a single magnetic pole on the entire interior surface of the cylindrical magnet and then opposite single magnetic pole on the outside surface of the cylindrical magnet. The length of the magnet is chosen to determine the two positions the ball is to take. As will be illustrated further below, the spherical ball will either position itself at one end of the cylindrical magnet device or at the other end, in each case with the spherical body having its center in line with the end of the magnetic device.

Figure 1:
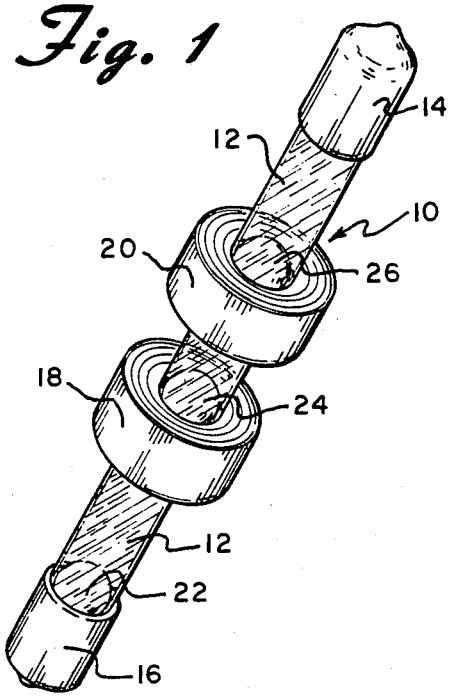
FIG. 1 is a perspective view of a puzzle device of the present invention.

Puzzle device 10 is illustrated in FIG. 1 constructed of a $\frac{3}{8}$ inch diameter clear cellulosic plastic tubing 12 about six inches long, with caps 14 and 16 closing off the ends of tubing 12. Spaced apart and spaced from each other are annular tube ring magnets 18 and 20. Magnets 18 and 20 are constructed of magnet strip material about 0.06 inches thick by $\frac{3}{8}$ inch wide with multiple wraps of about 11 inches long adhesively laminated together around tube 12. The magnetic material is polymeric plastic filled with magnetic particles and magnetized such that one side is one magnet pole and the other is opposite magnet pole. Constructed in this fashion, the magnets are in series and the magnet flux is reinforced. As constructed, there is one magnet pole on the inside surface of the annular ring and a second opposite magnetic pole on the outside surface of the magnet ring. Three balls, 22, 24 and 26 are trapped inside tube 12. Ball 22 is positioned by gravity proximate to cap 16. Ball 24 is held in position by the magnet flux of magnet 18. Ball 26 is held in position by the magnetic flux of magnet 20. Each of the balls are steel and capable of attraction by the magnetic flux. Substitute materials may be used so long as tube 12 is nonmagnetic in nature and the balls are attracted by magnetic flux. Each of the balls are approximately $\frac{3}{8}$ in diameter. The sizes are chosen so that the ball moves easily but is a close fit along the length of tube 12. The balls may slide along tube 12 but generally will roll as a result of their shape and the angle of tube 12. As should be apparent, there can be any number of magnets along the tube and an equal number of balls plus one. For example, it is quite feasible to have four magnets spaced apart along the tube together with five balls. Of course, the positioning of the balls into proper alignment is more difficult as the number of balls is increased.

Figure 2:
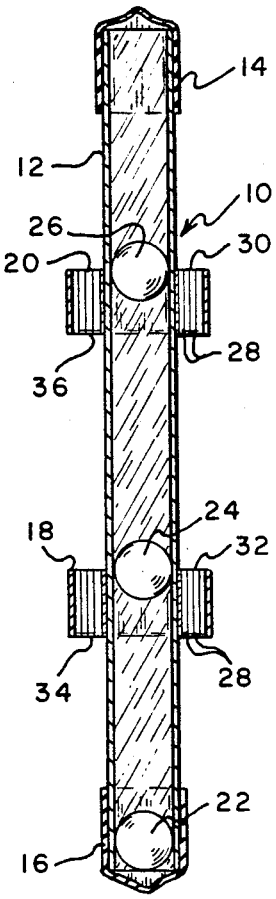
FIG. 2 is a cross-sectional view of the device of FIG. 1 taken along the central axis of the tubular body.
Figure 3:
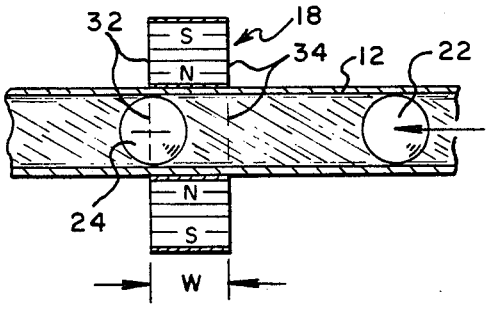
FIG. 3 is a cross-sectional view of a portion of the device of FIG. 2.

In FIG. 2, the cross-sectional view more accurately illustrates the position of the various components of device 10. Magnets 18 and 20 are constructed of a plurality of layers of magnetic stripping material wrapped in windings 28. The magnetic stripping material is a flexible polymeric composition containing suspended particulate capable of being magnetized. The magnetic configuration of the stripping sheet is magnetized transverse through the thickness of the sheet. The wraps thus form the thickness of the sheet. The wraps thus form a magnet structure with North and South Poles abutting and with one pole on the outside of the layered structure and the opposite pole on the inside. The general form of the magnet wraps is described in pending U.S. patent application Ser. No. 514,258, filed July 15, 1983, incorporated herein by reference. Ball 26 is held at the upper edge of magnet 20 such that the center of gravity is in alignment with the outside upper end 30 of magnet 20. Likewise, ball 24 is held by magnet 18 at upper edge 32. It is the position in FIG. 2 of the balls 22, 24 and 26 that is the solution to the puzzle device 10. When the balls are in this position, and tube 12 is tilted such that cap 14 is now pointed downwardly and cap 16 is pointed upwardly, ball 22 will roll toward cap 14 and strike ball 24. Ball 24 is by the contact caused to leave the magnetic flux influence of magnet 18 and roll downwardly toward cap 14. On the other hand, ball 22 by contacting and striking ball 24 is caused to stop and remain in the influence of the flux of magnetic 18. However, ball 22, rather than being held at a point where its center of gravity is in the plane of edge 32 is now held in the plane of edge 34, that being the edge downwardly and toward cap 16 at the point where ball 22 entered the influence of magnet 18. Ball 24, continues its downward path until its strikes ball 26 moving it out of the influence of magnet 20 and to the end of tube 12 closed by end cap 14. Like ball 22, ball 24 is now captured by the magnetic flux of magnet 20. Again, it is positioned in the only position it can take, that being where its center of gravity is in alignment with edge 36, the leading edge of magnet 20, coming from that direction. As further illustrated in FIG. 3, a schematic diagram of the entrance of ball 22 into the influence of magnetic 18 is shown. Ball 24 is held in position by magnet 18 where the magnetic flux of the north pole on the inside of the ring magnet and the south pole on the outside of the ring magnet holds ball 24 in alignment with edge 32 passing essentially through the center of gravity of ball 24. As ball 22 is moved toward magnet 18, it comes into influence and strikes ball 24. Ball 24 receives momentum equal to that of ball 22, is moved out of the magnetic flux influence, and rolls down the tube in the same direction as ball 22 was traveling. Using the conservation of momentum, ball 22 will essentially come to a stop and will be held in position along end line 34 by the magnetic flux of magnet 18. Edge line 34 will pass essentially through the center of gravity of ball 22 while ball 22 is held in position. The ball position for each magnet may be considered to be stable positions at which point the ball will come to rest and be held in that alignment.

The width of magnet 18 is approximately equal to the diameter of ball 22 and 24. In this fashion, the positioning of the ball at the edge of the magnet is essentially automatic with minimum loss of energy.

Figure 4:
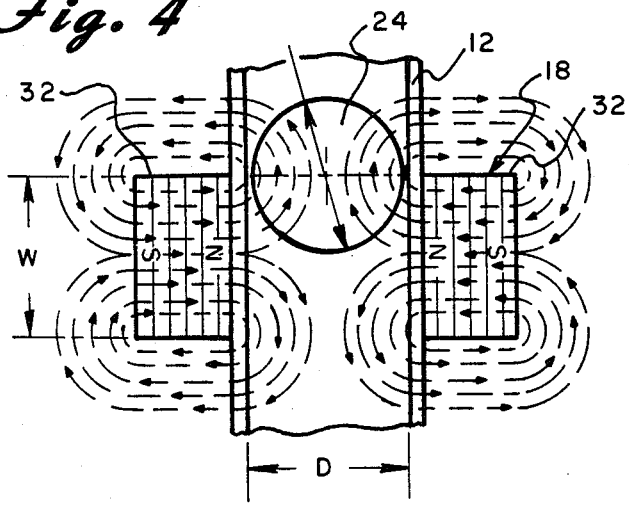
FIG. 4 is a schematic diagram of a expanded view of the steel ball positioning device of the present invention utilized in the puzzle device of FIG. 1 and other devices.

As further illustrated in FIG. 4, the lines of magnetic flux are schematically illustrated showing the force on ball 24. Again, the width of magnet 18 is shown as "W" and the inside diameter of tube 12 is designed "D". The diameter of ball 24 is slightly less than W and D which are approximately equal. Ball 24 will stabilize where the length of the flux lines traveling through the ball are the largest. Those flux lines are the longest when the center of gravity of the ball is in alignment with the one of the two edges of magnet 18.

Figure 5:
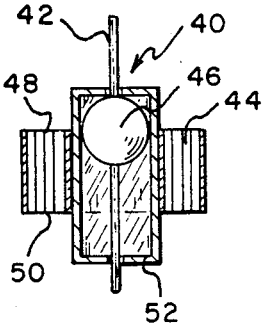
FIG. 5 is a double detent device of the present invention involving a switch mechanism utilizing a principle of the invention illustrated in FIG. 4.

As illustrated in FIG. 5, a simple use of the present invention is illustrated. For a variety of applications including switches and other devices, it is desirable to position a member exactly. This can be used with a detent, a spring or other devices which tend to wear out and have other disadvantages. FIG. 5 illustrates device 40 which controls the position of rod 42 in one of two positions, that being to the top or to the bottom of the device. Magnet 44 provides a magnetic flux pattern due to the continuous winding of sheet magnet stock in a plurality of layers placing one polarity on the inside of the ring magnet and the opposite polarity on the outside surface of the ring magnet. Like the devices illustrated in FIGS. 1 through 4, ball 46 is of a composition attracted by magnetic flux, and is held in position either at the top edge of magnet 44 or at the bottom edge of magnet 44. An advantage of this device is that ball 46 is held in alignment with edge 48 or in the alternative in alignment with edge 50 in and no other position. Thus, intermediate positions of ball 46 which is fixed to rod 42 are essentially impossible. As a result, rod 42 is either in the 37 up" position or in the "down" position and a positive force holds the rod in either of two positions. On the other hand, rod 42 may be moved by a sufficient force to the new position providing a sure signal that the rod is in the correct position. This device is useful in electrical switches, and other devices. Housing 52 is a nonmagnetic material providing a path for ball 46 to move from one position to the other. Holes in the end of housing 52 allow rod 42 to slide freely in and out of housing 52. The position of the ends of housing 52 may coincide with the positioning of ball 46 with magnet 44 but that is not necessary for the operation of the device as magnet 44 will hold ball 46 in one of the two correct positions.

A body having a plane of symmetry may replace ball 46 as long as the plane of symmetry comes into alignment with the plane of an end of the tubular magnet. Of course, a sphere has an infinite number of planes of symmetry. An obloid or a rectangular prism may be used and it is important that the surface edge of the plane chosen, be adjacent and close to the inside surface of the tubular magnet.

While this invention has been described with reference to the specific embodiments disclosed herein, it is not confined to the details set forth and the patent is intended to include modifications and changes which may come within and extend from the following claims.

I claim:

1. A puzzle device comprising:

(a) a transparent cylindrical tubular body of nonmagnetic material, (b) closing means to close each end of the tubular body, (c) a plurality of annular tubular magnets spaced along the length of the tubular body, each tubular magnet, (i) having a length along the direction of the length of the tubular body, (ii) having a single magnetic pole on the entire interior surface of the tubular magnet surface, and (iii) having the opposite signal magnetic pole on the entire exterior surface of the tubular magnet surface, and (d) a plurality of magnetically attracted balls in the tubular body, each ball of a diameter to allow easy rolling movement along the length of the tubular body, the number of the balls positioned inside the tubular body equal to the number of tubular magnets plus one, wherein the length of the tubular magnets are about the same distance as the diameter of the balls.

2. The device of claim 1 wherein the closing means are plastic caps fitting over the end of the cylindrical tubular body.

3. The device of claim 2 wherein the caps are transparent or at least translucent.

4. The device of claim 1 wherein the inside diameter of the tubular body is just slightly larger than the diameter of the balls.

5. The device of claim 1 wherein the tubular magnets comprise a plurality of wraps of layers of sheet material having the characteristics of a magnet, one magnetic pole on one surface and the opposite pole on the opposite surface of the sheet.

6. The device of claim 1 wherein the inside diameter of the tubular body, the diameter of the balls, and the length of the magnet is about three eighths of an inch.

7. A detenting device comprising:

(a) a magnetically attracted body having a plane of symmetry, (b) a containing means of nonmagnetic material having a length, and a cross-sectional area normal to the length, wherein the cross-sectional area is sufficient to allow the body to freely move along the length, (c) an annular tubular magnet surrounding the the cross-section area having two ends separated along the length of the containing means wherein there is one magnetic pole on the entire inside surface of the tubular magnet and the opposite magnetic pole on the entire outside surface of the tubular magnet, and (d) a moving means to move the body from one end of the magnet to the other end, while maintaining the plane of symmetry parallel to the cross-sectional area.

8. The detenting device of claim 7 wherein the containing means is a tubular housing.

9. The detenting device of claim 8 wherein the containing means comprises two ends closing the cylindrical tube with each end having an aperture generally positioned opposed to each other.

10. The detenting device of claim 7 wherein the tubular magnet comprises a single continuous wrap of sheet material having the characteristics of a magnet wherein the sheet has one magnetic pole on one surface and and opposite magnetic pole on the opposite surface of the sheet.

11. The detenting device of claim 7 wherein the body is a sphere.

12. The detenting device of claim 11 wherein the body is a steel sphere.

13. The detenting means of claim 7 wherein the moving means comprises at least one member fixedly attached the body of a length to extend through an aperture in the containing means.

14. The detenting device of claim 13 wherein the moving means comprises a pair of members attached to and extending from the body along the length of the containing means with each member extending to a point outside the containing means where force may be applied to either member to move the body from one end of the magnet the other end.

15. A detenting device comprising:

(a) a magnetically attracted spherical body, (b) a housing of nonmagnetic material having a length and a cross sectional area normal to the length, two closure means to close each end of the housing and two apertures, one through each end generally positioned opposed to each other, (c) an annular tubular magnetic surrounding the housing having two ends separated along the length of the housing wherein there is one magnetic pole on the entire inside surface of the tubular magnet and the opposite magnetic pole on the entire outside surface of the tubular magnet, and (d) a moving member means fixedly attached to the spherical body to move the body from end of the magnet to the other end.

* * * * *